US008555955B2

(12) United States Patent
Davis

(10) Patent No.: US 8,555,955 B2
(45) Date of Patent: Oct. 15, 2013

(54) ONE TRIP MULTIPLE STRING SECTION MILLING OF SUBTERRANEAN TUBULARS

(75) Inventor: John P. Davis, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 388 days.

(21) Appl. No.: 12/974,145

(22) Filed: Dec. 21, 2010

(65) Prior Publication Data

US 2012/0152543 A1 Jun. 21, 2012

(51) Int. Cl.
*E21B 43/112* (2006.01)

(52) U.S. Cl.
USPC ..... 166/55.8; 166/298

(58) Field of Classification Search
USPC ..... 166/55, 55.6–55.8, 298; 175/265–266
See application file for complete search history.

(56) References Cited

U.S. PATENT DOCUMENTS 2,110,913 A * 3/1938 Lowrey ..... 166/55.8
2,899,000 A 8/1959 Medders et al.
4,776,394 A 10/1988 Lynde et al.
4,796,709 A 1/1989 Lynde et al.
4,887,668 A 12/1989 Lynde et al.
4,938,291 A 7/1990 Lynde et al.
4,978,260 A 12/1990 Lynde et al.
5,010,955 A * 4/1991 Springer ..... 166/298
5,058,666 A 10/1991 Lynde et al.
5,150,755 A 9/1992 Cassel et al.
5,265,675 A 11/1993 Hearn et al.
5,297,630 A 3/1994 Lynde et al.
5,373,900 A 12/1994 Lynde et al.
5,456,312 A 10/1995 Lynde et al.
5,735,359 A * 4/1998 Lee et al. ..... 175/269
5,868,212 A 2/1999 McManus
6,227,313 B1 5/2001 Davis et al.
6,679,328 B2 1/2004 Davis et al.
6,920,923 B1 7/2005 Pietrobelli et al.
2005/0133224 A1 6/2005 Ruttley

* cited by examiner

*Primary Examiner* — Giovanna Wright
(74) *Attorney, Agent, or Firm* — Steve Rosenblatt

(57) ABSTRACT

Multiple section mills are run in a single trip with an intervening mill preferably a watermelon mill to grind up any cuttings that get past the first mill in a direction toward the second mill below it. The blades of the second mill are held by the innermost tubular until the location of the initial cut is reached at which point the longer arms of the second mill can be extended and its body centralizes due to the flexibility of the connection between the mills.

20 Claims, 1 Drawing Sheet

ONE TRIP MULTIPLE STRING SECTION MILLING OF SUBTERRANEAN TUBULARS

FIELD OF THE INVENTION

The field of the invention is cutting away a section of subterranean tubulars to extend a well in a new direction and more particularly where multiple strings are cut in a single trip.

BACKGROUND OF THE INVENTION

When it is time to extend a well in a new direction, there were several options available. A whipstock could be used off an anchor to send a bit in a desired direction through a casing but there were some risks involved that the whipstock could shift and the exit could go off in an undesired location.

Section milling is a technique that removes a section of nested tubulars so that the well can be extended in a desired direction. In the past when there were nested tubulars the procedure was to cut each string with a separate mill with one mill being run into the well at a time. One of the fears that directed the multiple trip approach was that the initial cut by the smallest section mill would generate cuttings that could ball up the mill below if two mills were run at the same time. Another concern was that the two mill assembly if run into the hole at the same time would not be flexible enough as an assembly so that the second mill could center itself and avoid cutting another string outside the second string being cut in a situation where the strings were not concentric so that at some points the strings were literally in contact while in other peripheral locations at the same elevation there were large gaps between adjacent strings.

Most section cuts were made in a downhole direction. This technique increased the hole diameter for the circulating fluid as the cutting progressed which in turn required an increase in circulating fluid rate to maintain the velocity in the newly widened portion so that cuttings did not drop out. In one example the section milling was done in an uphole direction using a thruster to hold tension and an augur below a mill operated with either a downhole motor or string rotation to make the cut. This single mill method is illustrated in U.S. Pat. No. 6,679,328. Other related art to tubular section milling can be found in U.S. Pat. Nos. 6,227,313; 5,456,312; 5,373,900; 5,297,630; 5,150,755; 5,058,666; 4,978,260; 4,796,709; 4,938,291; 4,887,668; and 4,776,394. U.S. Pat. No. 5,265,675 shows a pivoting stabilizer combined with a single section mill.

What is needed and has not been available is a multiple mill system for section milling. The present invention offers such a system and incorporates into it an intermediate mill that can take what cuttings that travel to the adjacent mill to be made far smaller so that the second and larger mill will not get balled up when it is called upon to make the subsequent cut. The placement of an interim mill such as a watermelon mill between the pivoting arm type section mills gives the second mill a more flexible mounting so that it can center itself in the enlarged space created by the initial milling to lessen the possibility that an adjacent and off-center third string will not get cut as the second mill is operated. The second mill has features that keep its arms from extending until it gets out into the region cut by the initial mill. These and other features of the present invention will be more apparent to those skilled in the art from a review of the description of the preferred embodiment and the associated drawings while recognizing that the full scope of the invention is to be found in the appended claims.

SUMMARY OF THE INVENTION

Multiple section mills are run in a single trip with an intervening mill preferably a watermelon mill to grind up any cuttings that get past the first mill in a direction toward the second mill below it. The blades of the second mill are held by the innermost tubular until the location of the initial cut is reached at which point the longer arms of the second mill can be extended and its body centralizes due to the flexibility of the connection between the mills.

DETAILED DESCRIPTION OF THE PREFERRED EMBODIMENT

Figure 1:
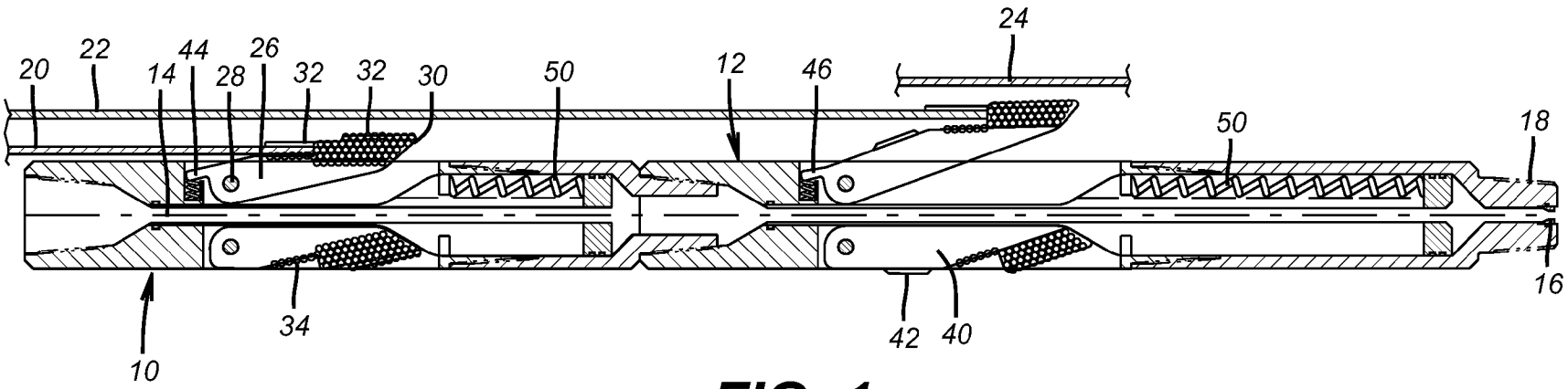
FIG. 1 is a section view of the assembly of two section mills for milling different sized tubulars in a single trip.
Figure 3:
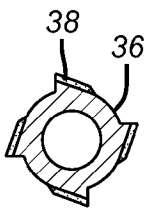
FIG. 3 is a view along lines 3-3 of FIG. 2.

FIG. 1 is a split view showing a primary mill 10 above a secondary mill 12. The run in position is shown at the bottom of the FIG. while the extended position is shown at the top of the FIG. A common passage 14 runs through mills 10 and 12 and a flow restriction 16 is located at the lower end 18 of mill 12. First string 20 is nested in second and larger string 22 and a third string 24 can be disposed about the string 22. Mill 10 has arms 26 that turn about pivot 28 so that a plurality of blades 30 each with a leading face 32 can cut clean through the tubular 20. Continuing rotation with the blades 30 extended cuts the lower end 32 from the bottom up and a row of inserts 34 ride on the inside wall of the tubular string 20 and cut it from the inside wall as the mill 10 advances in an uphole direction toward the borehole surface.

One or more joints 36 with a mill 38 on at least one of the joints are preferably located between the mills 10 and 12. The location of the mill 38 which is depicted as a preferred design of a watermelon mill, accomplishes two tasks. If there are cuttings from the operation of the mill 10 that are not circulated out of the hole and instead head downhole toward mill 12 then those cuttings have to go past mill 38 where they get cut up even finer so they are less likely to prevent mill 12 from extending and cutting the tubular 22 when mill 12 moves up high enough to extend in the location where tubular 20 has already been sectioned out.

Lower mill 12 is similar in operation to mill 10 with the exception that arms 40 are longer than arms 26 and the addition of a wear pad 42 on each arm 40 that rubs on the interior of tubular 20 below where tubular 20 is sectioned by mill 10 to prevent the arms 40 from pivoting outwardly until they are pulled clear of the section cut by mill 10.

Figure 2:
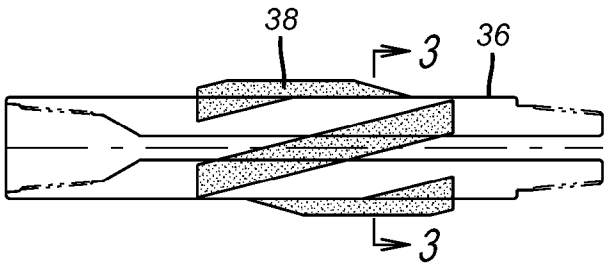
FIG. 2 is a joint with a watermelon mill that is assembled preferably between the section mills during the single trip.

Flow down passage 14 eventually drives out first the arms 26 to section the tubular 20 and then the arms 40 to section tubular 22 in the opening made by mill 10. Mill 12 is better able to center itself with respect to the tubular 22 when cutting the larger tubular in the region where tubular 20 has already been removed because the connection between the mills 10 and 12 is flexible using one or more joints 36 shown in FIG. 2.

Mill 10 has a rotational stop 44 to keep its extension to the outer dimension of the tubular 20 and mill 12 has a travel stop 46 to keep its extension to the outer surface of the tubular 22. Arms 26 extend by fluid pressure against the bias of springs 48 and arms 40 extend in response to the same pressure against springs 50 when mill 12 is raised up so that wear pads 42 enter the portion that is sectioned out of tubular 20.

Additional tubulars, or centralizers or mills can be attached at 18 for a variety of reasons. The additional tubular or centralizer helps to keep mill 12 centered when cutting tubular 22. Another watermelon or other mill below mill 12 can help cut up any cuttings that go downhole past mill 12 despite the circulation through passage 14 that is intended to bring the cuttings to the surface. Optionally another mill with longer arms than mill 12 can be installed below it for removal of another surrounding tubular. Those skilled in the art will appreciate that there are structural cutting limits to arms that have to extend radially and mill while being rotated so that at some point a limit can be reached in how many nested tubulars can be cut in a single trip.

The present invention offers the ability to cut multiple tubulars that are nested in a single trip. This is in part made possible by providing flexibility between the mills so that the second mill that section an outer tubular can center itself in the sectioned inner tubular and avoid excursions that would damage a third outer tubular that may be laying against the second tubular that is being sectioned. The provision of a mill to cut the first mill cuttings even finer if the cuttings move downhole to the second mill instead of being circulated out allows greater operational reliability for the second mill. The first tubular below the sectioning is protected from damage by the lower mill because of wear pads that keep the arms of the second mill from extending before the uphole movement of the mills in tandem raises the lower mill to where the inner tubular has already been sectioned. The cutting in the uphole direction with multiple mills in a single trip also allows the maintenance of circulation velocities as the return flow with cuttings comes to the surface at a portion above where the sectioning is happening so that there is no large diameter increase as there would be if sectioning in the downhole direction so that the cuttings are more effectively removed to the surface.

The above description is illustrative of the preferred embodiment and many modifications may be made by those skilled in the art without departing from the invention whose scope is to be determined from the literal and equivalent scope of the claims below.

I claim:

1. An assembly for subterranean section milling multiple nested tubulars in a single trip from a location at a surface, comprising:

at least a first and a second section mills having different reach and supported from the surface for sectioning nested inner and outer tubulars in a single trip;

said first section mill, when fully extended, extending radially beyond an outer surface of said inner tubular for sectioning thereof and said second section mill, when fully extended, extending radially beyond an outer surface of the outer tubular for sectioning thereof.

2. The assembly of claim 1, wherein:

said mills are spaced apart by a member that provides flexibility for said second mill, located further from the surface than said first mill, to centralize said second mill when said second mill sections a tubular further out from the tubular sectioned by said first mill.

3. The assembly of claim 2, wherein:

said first and second mills are spaced apart by a member that supports a mill to further cut cuttings from the first mill before they reach the second mill.

4. The assembly of claim 1, wherein:

said first and second mills are spaced apart by a member that supports a mill to further cut cuttings from the first mill before they reach the second mill.

5. An assembly for subterranean section milling multiple nested tubulars in a single trip from a location at a surface, comprising:

at least a first and a second section mills having different reach and supported from the surface for sectioning nested tubulars in a single trip;

said first and second mills are spaced apart by a member that supports a mill to further cut cuttings from the first mill before they reach the second mill;

said mill on said member comprises a watermelon mill.

6. An assembly for subterranean section milling multiple nested tubulars in a single trip from a location at a surface, comprising:

at least a first and a second section mills having different reach and supported from the surface for sectioning nested tubulars in a single trip;

said second mill comprises arms that further comprise a wear pad to ride in an innermost of the nested tubulars as that tubular is sectioned by said first mill.

7. An assembly for subterranean section milling multiple nested tubulars in a single trip from a location at a surface, comprising:

at least a first and a second section mills having different reach and supported from the surface for sectioning nested tubulars in a single trip;

said mills section the tubulars in a direction toward the surface.

8. An assembly for subterranean section milling multiple nested tubulars in a single trip from a location at a surface, comprising:

at least a first and a second section mills having different reach and supported from the surface for sectioning nested tubulars in a single trip;

said mills are spaced apart by a member that provides flexibility for said second mill, located further from the surface than said first mill, to centralize said second mill when said second mill sections a tubular further out from the tubular sectioned by said first mill;

said first and second mills are spaced apart by a member that supports a mill to further cut cuttings from the first mill before they reach the second mill;

said mill on said member comprises a watermelon mill.

9. An assembly for subterranean section milling multiple nested tubulars in a single trip from a location at a surface, comprising:

at least a first and a second section mills having different reach and supported from the surface for sectioning nested tubulars in a single trip;

said mills are spaced apart by a member that provides flexibility for said second mill, located further from the surface than said first mill, to centralize said second mill when said second mill sections a tubular further out from the tubular sectioned by said first mill;

said first and second mills are spaced apart by a member that supports a mill to further cut cuttings from the first mill before they reach the second mill;

said second mill comprises arms that further comprise a wear pad to ride in an innermost of the nested tubulars as that tubular is sectioned by said first mill.

10. The assembly of claim 9, wherein:

said mills section the tubulars in a direction toward the surface.

11. A method of sectioning nested subterranean tubulars in a single trip from a surface, comprising:

running in multiple mills into nested tubulars in a single trip;

operating a first mill to section the inner tubular of the nested tubulars; and operating a second mill to cut a second nested tubular through the cut made in said inner tubular.

12. The method of claim 11, comprising:

flexibly mounting the second mill to the first mill;

using said flexible mounting to centralize said second mill during its operation.

13. The method of claim 12, comprising:

providing a cuttings mill between said first and second mills to further cut any cuttings that pass between said first and second mills.

14. The method of claim 13, comprising:

using a watermelon mill as said cuttings mill.

15. The method of claim 14, comprising:

providing a wear pad on the arms of said second mill to ride on an inside surface of the first tubular to be sectioned to prevent said arms from extending until said wear pad reaches the section made by said first mill.

16. The method of claim 15, comprising:

operating said first and second mill to section in a direction toward the surface.

17. The method of claim 11, comprising:

providing a cuttings mill between said first and second mills to further cut any cuttings that pass between said first and second mills.

18. The method of claim 13, comprising:

using a watermelon mill as said cuttings mill.

19. The method of claim 11, comprising:

providing a wear pad on the arms of said second mill to ride on an inside surface of the first tubular to be sectioned to prevent said arms from extending until said wear pad reaches the section made by said first mill.

20. The method of claim 11, comprising:

operating said first and second mill to section in a direction toward the surface.

* * * * *